US006557614B1

(12) United States Patent
Lampers

(10) Patent No.: US 6,557,614 B1
(45) Date of Patent: May 6, 2003

(54) RETRACTABLE GARAGE DOOR SCREEN INSTALLATION

(76) Inventor: Nicholas Lampers, 18039 Crystal River Dr., Macomb Township, MI (US) 48042

( * ) Notice: Subject to any disclaimer, the term of this patent is extended or adjusted under 35 U.S.C. 154(b) by 0 days.

(21) Appl. No.: 09/976,480

(22) Filed: Oct. 12, 2001

(51) Int. Cl.[7] ..... E06B 3/48
(52) U.S. Cl. ..... 160/113; 292/DIG. 36
(58) Field of Search ..... 160/113, 87, 89, 160/90, 102, 103, 118, 205, 201; 292/DIG. 36, 38, 36, 33, 35, 336.3

(56) References Cited

U.S. PATENT DOCUMENTS 3,683,652 A * 8/1972 Halopoff et al. ..... 292/DIG. 36
3,938,577 A * 2/1976 Richards ..... 160/113 X
4,080,757 A * 3/1978 Westerman ..... 292/DIG. 36
4,653,566 A * 3/1987 Miale ..... 160/113 X
4,739,584 A * 4/1988 Zellman ..... 292/DIG. 36
5,408,789 A * 4/1995 Plfeger ..... 160/113 X
5,489,130 A * 2/1996 Clark ..... 292/DIG. 36
5,611,382 A * 3/1997 Sferra ..... 160/113
5,848,630 A * 12/1998 Manzo ..... 160/113
5,860,465 A * 1/1999 Eastridge et al. ..... 160/113
6,092,580 A * 7/2000 Lucas ..... 160/113

* cited by examiner

*Primary Examiner*—David M. Purol
(74) *Attorney, Agent, or Firm*—John R. Benefiel

(57) ABSTRACT

A retractable screen panel installation for a garage door in which the screen panel may be held latched in a position overlying a lowermost section of a garage door, and selectively released to slide down to cover an opening created when the door is partially raised. A one handed operation of two laterally spaced latching mechanisms releases the screen panel by squeezing together two angled end pivoted release levers each connected to a respective cable release element.

4 Claims, 4 Drawing Sheets

RETRACTABLE GARAGE DOOR SCREEN INSTALLATION

BACKGROUND OF THE INVENTION

This invention concerns screens for garage doors of a type which are mounted to the bottom of the door and are able to be released to slide down and cover the opening formed beneath the bottom edge of the door when the door is partially opened. Such a screen installation is shown in U.S. Pat. Nos. 5,611,382; 5,860,465; and 4,653,566.

Garage door screens are advantageous as they allow ventilation while preventing the entrance of animals, insects, wind blown debris, etc.

These screens are intended to be installed on standard 8 or 16 foot garage doors, with the screen being of equal length. This relatively long length makes it desirable for two are more latches to be used to hold the screen in an elevated position so that the screen panel does not tilt to become angled with respect to the garage door. These latches of necessity are widely spaced such that it is inconvenient and relatively slow to release the screen panels by walking back and forth across the width of the door to release one and then the other.

It is the object of the present invention to provide a retractable garage door screen installation with a more convenient latch release mechanism.

SUMMARY OF INVENTION

The above recited object of the invention and other objects which will be appreciated upon a reading of the following specification and claims, are achieved by providing two or more widely spaced latching mechanisms each comprised of a spring loaded plunger pin urged into an opening located to support the screen panel in a raised position juxtaposed behind the lower section of the garage door.

A pair of common operator levers are located at a remote control location, each connected by a cable to a respective plunger. The release levers are disposed close together so that a pinching motion exerted by a finger and thumb of one hand can simultaneously retract both of the plungers to release the screen panel and allow downward movement thereof on a series of slides. Thus, release can be effected at a single location along the width of the door to render operation quicker and easier.

DETAILED DESCRIPTION

Figure 1:
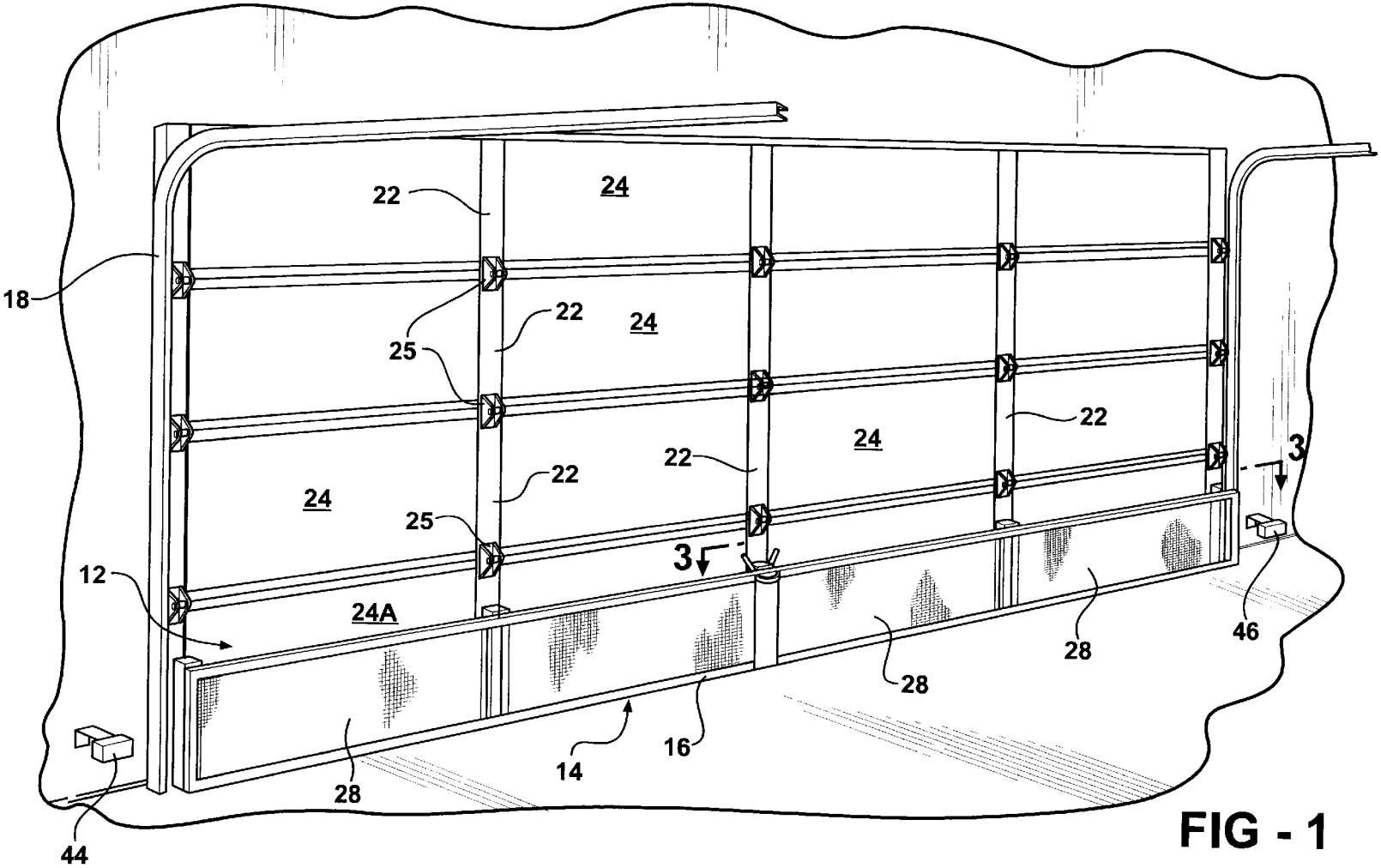
FIG. 1 is a perspective view of the inside of a garage door having a screen installation according to the invention mounted thereon, shown in the stored position.
Figure 2:
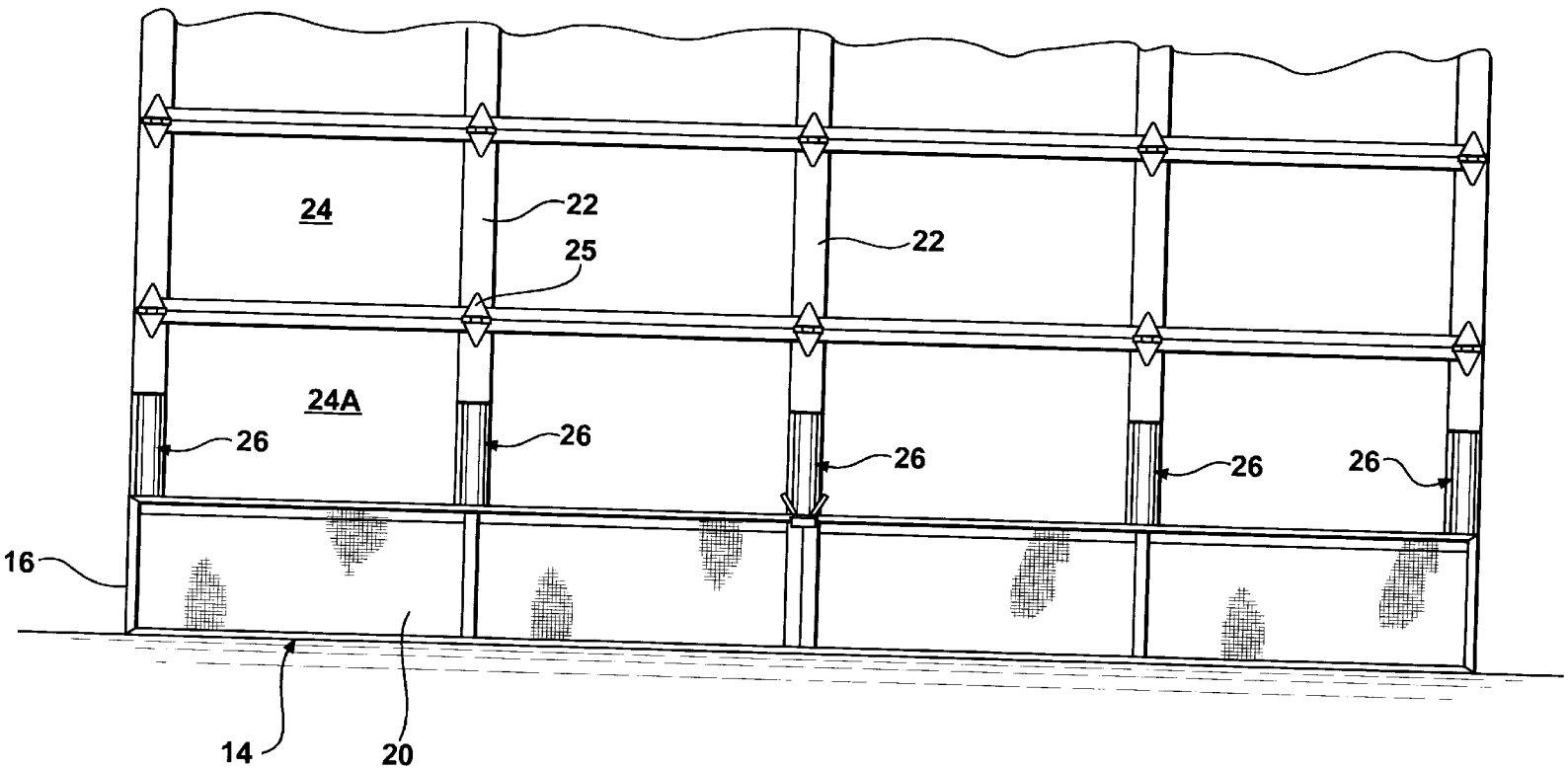
FIG. 2 is a rear elevational view of the garage door and screen installation shown in FIG. 1, partially broken away with the screen lowered to cover an opening below the door.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a conventional sectional garage door 10 is shown having a screen installation 12 mounted thereon which includes a screen panel 14 of a length approximately matching the width of the garage door 10, i.e., approximately sixteen feet for a standard two car garage, or eight feet for a standard single car garage door.

Such sectional garage doors move up and down vertically on tracks 18 at either end, the door sections 24 hinged together in the well known manner to accommodate the curvature of the tracks 18 as the door moves to a horizontal opened position over the garage opening.

The screen panel 14 may include an aluminum frame 16 having panels of screen material 20 installed therein.

Each section 24 of the door 10 is reinforced with a series of vertical stiffeners 22, with mounting hinges 25 interconnecting adjacent sections 24 of the garage door 10.

The screen panel 14 is approximately fifteen inches in height (which height can vary depending on the type of door) and may be stowed in the retracted position shown in FIG. 1 overlying the lowermost section 24 of the garage door 10.

Figure 4:
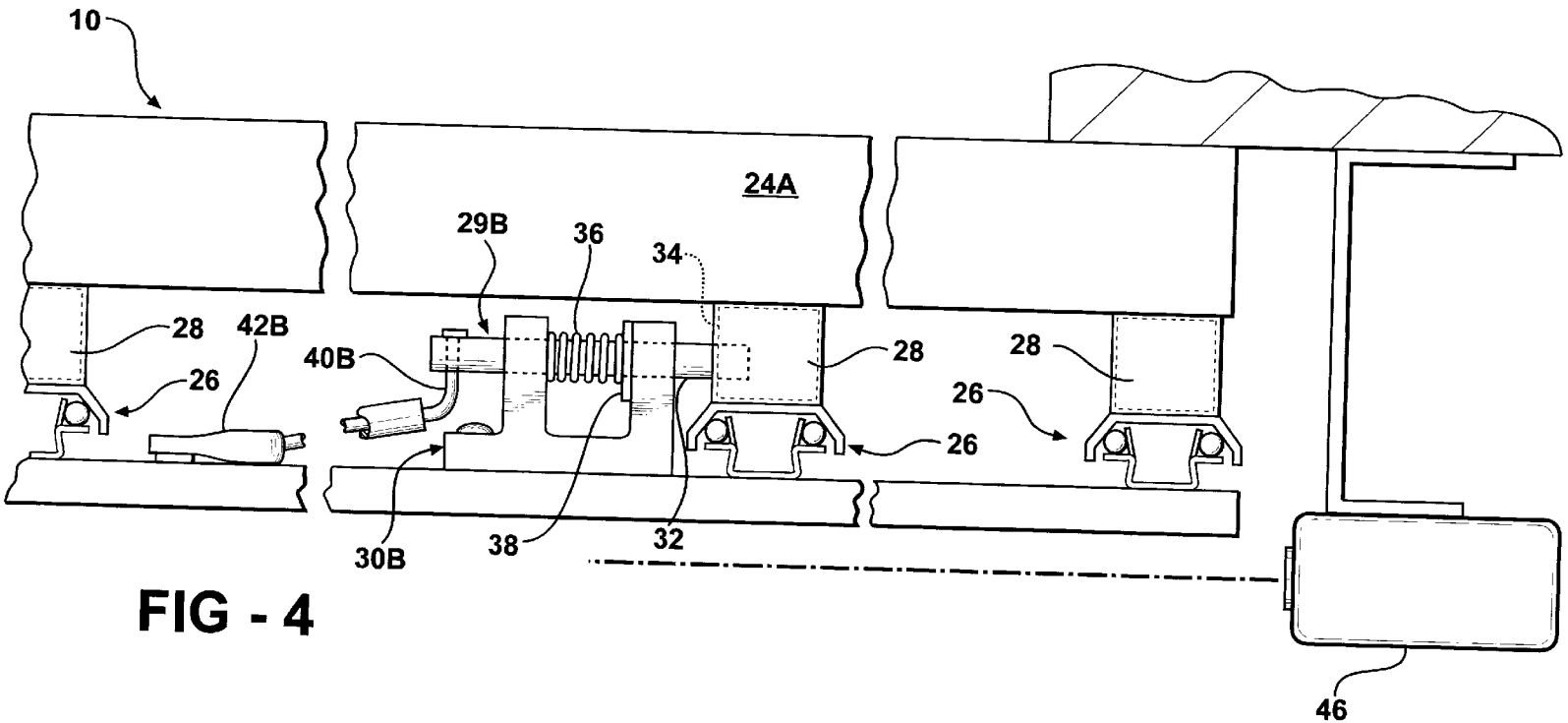
FIG. 4 is a fragmentary enlarged view of portions of the door and screen in the direction of the arrows 4—4 in FIG. 1.

The screen panel 14 is mounted aligned with the bottom section 24A of the door 10, vertically slidable on bearing extension slides 26 (FIG. 4) of a type widely used for drawers, cabinet shelves, etc., attached to the screen panel frame 16 and to vertical box tubes 28 of aluminum plastic or other material attached to the stiffeners 22 of the garage door 10.

Figure 5:
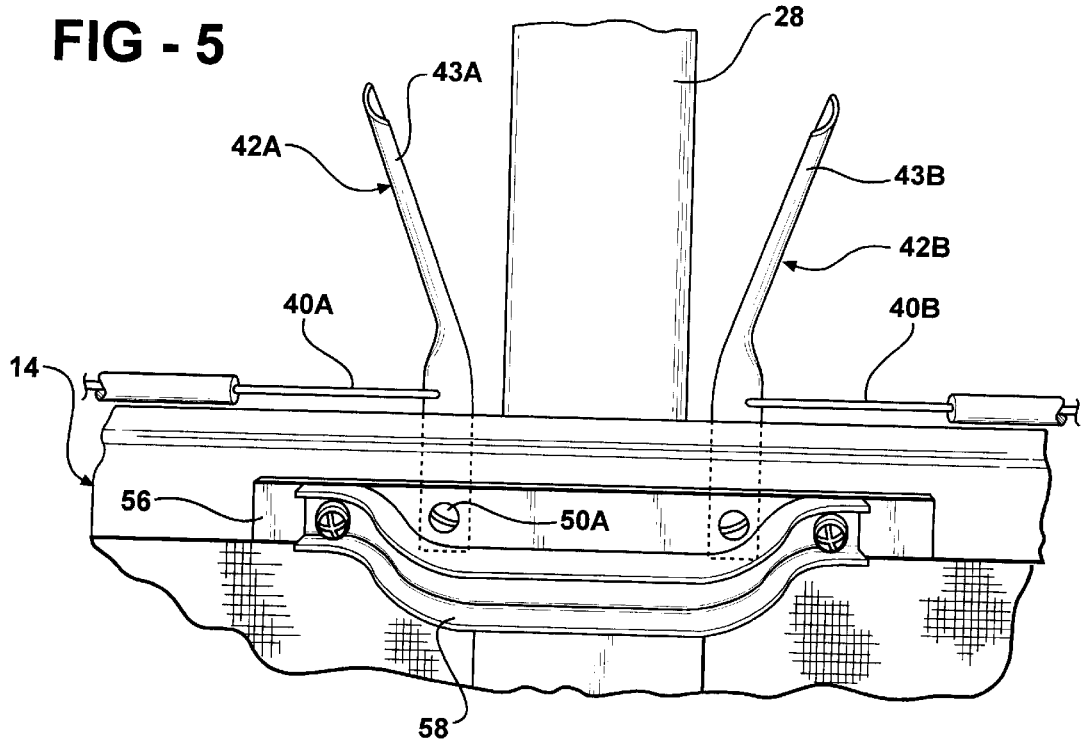
FIG. 5 is an enlarged frontal view of the central region of the screen showing the release lever mounting and a lifting handle.

As indicated in FIG. 5, the screen panel 14 may be constructed in two sections secured together with splice plates 56, a central handle 58 secured thereto for manual lifting or lowering of the screen 14.

Figure 3:
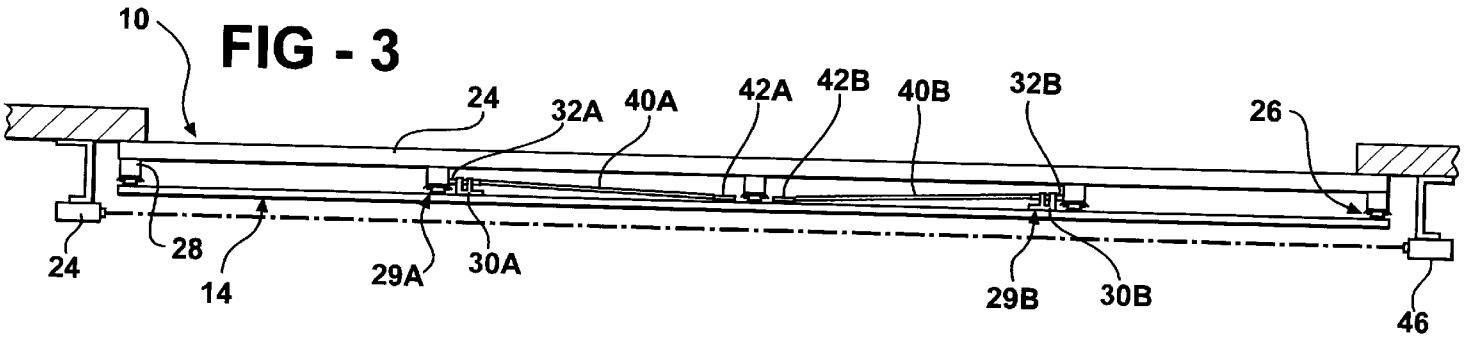
FIG. 3 is a top view of the door and screen shown in FIGS. 1 and 2 and associated obstruction detector.

A pair of latching mechanisms 29A, 29B respective include plastic brackets 30A, 30B respectively attached to the inside of the screen frame 16 adjacent respective spaced apart box beams 28 (FIG. 3).

A latching pin 32 is mounted in each bracket 30A, 30B urged into an aligned opening 34 in a respective box tube 28 by a spring 36 acting on a flange 38 attached to each pin 32A, 32B.

An actuator cable 40A, 40B is attached to the opposite end of each pin 32A, 32B and extends to a central location whereat release elements comprised of outwardly angled levers 42A, 42B are pivotally mounted at 50A, 50B to the inside of the screen panel frame 16. Each release lever 42A, 42B has an angled terminal portion 43A, 43B closely juxtaposed to each other (FIG. 5).

This juxtaposition allows simultaneous squeezing of the levers 42A, 42B together with a finger and thumb of one hand, simultaneously retracting both pins 32A, 32B and causing a release of the screen frame 16 to allow the screen 14 to move down as the door 10 is raised. The outward angling insures sufficient travel to release the pins 32A, 32B. The screen 14 will cover the opening created by partial opening of the door 10 to an extent equal or less than the height of the screen panel 14 to provide ventilation while preventing entry of animals, insects, or windblown debris such as fallen leaves.

When the garage door 10 is lowered, the pins 32A, 32B will become aligned with the holes 34A, 34B and automatically be pushed back into a respective opening 34 by springs 36A, 36B to relatch the screen 14 in its stowed position, moving up and down with the door 10.

The screen panel 14 and mounting is of a shallow depth such as to not interfere with the operation of an optical obstruction sensor 44 and target 46.

Figure 6:
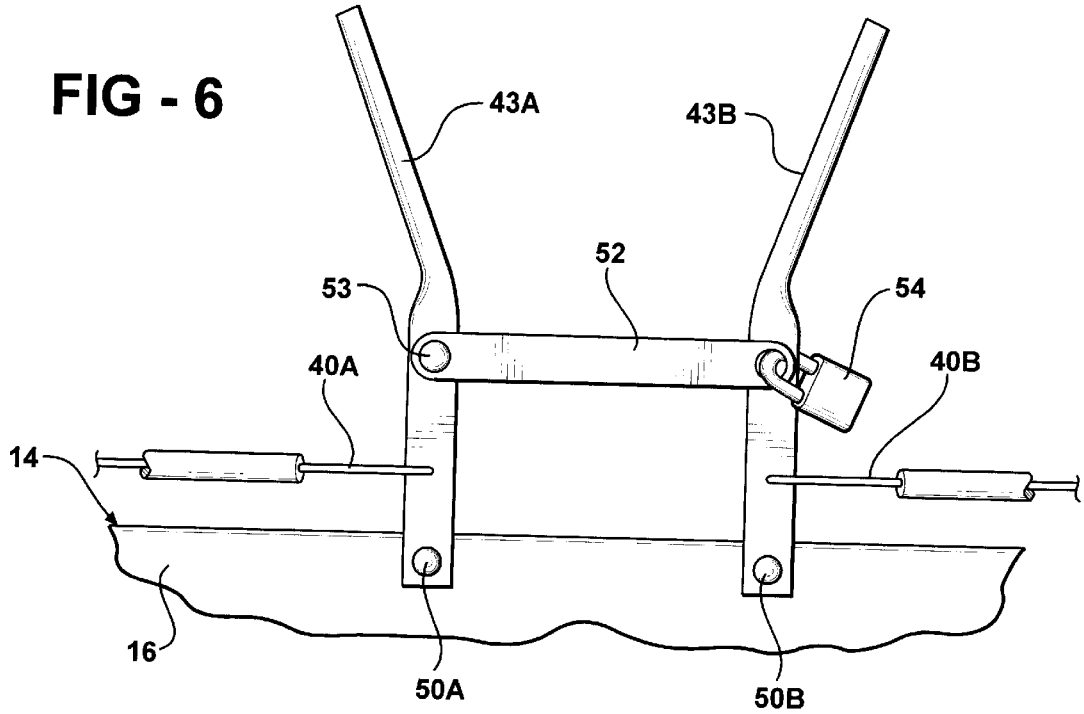
FIG. 6 is an enlarged view of the release levers of an alternate embodiment incorporating a child proofing lock-out feature.

FIG. 6 shows release levers 42A, 42B pivoted at 50A, 50B to the screen frame 16. A locking strut 52 is connected to prevent the levers 42A, 42B from being squeezed together to prevent release of the screen 14, held by a removable lock 54. Upon removal of the lock 54, the strut can pivot down on a screw 53 to allow the levers 42A, 42B to be squeezed together in the normal fashion.

What is claimed is:

1. A retractable screen installation in combination with a sectional garage door comprising:

a screen panel including a rectangular screen frame aligned with and slidably mounted to a lowermost section of said sectional garage door, said screen frame of a length approximately equal to the width of said lowermost door section and of a height such that said screen panel is able to cover an opening created when said garage door is partially raised to a height equal or less than the height of said screen panel;

a pair of laterally spaced part latching mechanisms each adapted to hold up a respective side of said screen panel in a retracted position overlying said lowermost door section, said latch mechanisms each including a selectively operable release operator and a manually engageable release lever associated with each latch mechanism release operator, said release levers located between said latch mechanisms at point each latch mechanism having a terminal portion juxtaposed with the terminal portion of the other release lever sufficiently close to each other so as to allow simultaneous manual release of both latch mechanisms by squeezing together said release lever terminal portions by an operator standing between the sides of the screen panel.

2. The installation according to claim 1 wherein said release operators each comprise a cable, and wherein each release lever terminal portion, is sufficiently close to be able to be squeezed together simultaneously with the fingers and thumb of one hand of an operator.

3. The installation according to claim 2 wherein each latching mechanism includes a spring loaded pin urged towards an opening in a member fixed to said garage door located to hold said screen panel overlying said lowermost panel when said pin is inserted in said hole.

4. The installation according to claim 2 further including a strut selectively connectable by a locking connection to prevent squeezing said release levers together and to prevent release of said latching mechanisms.

* * * * *